US005388329A

United States Patent [19]

Randlett et al.

[11] Patent Number: 5,388,329

[45] Date of Patent: Feb. 14, 1995

[54] METHOD OF MANUFACTURING A HEATING EXCHANGE TUBE

[75] Inventors: Myron R. Randlett, Cuba; Daniel J. Angeli, St. Louis, both of Mo.; Ralph L. Webb, State College, Pa.

[73] Assignee: Olin Corporation, Cuba, Mo.

[21] Appl. No.: 93,544

[22] Filed: Jul. 16, 1993

[51] Int. Cl.[6] ..... B23P 15/26

[52] U.S. Cl. ..... 29/890.049; 29/890.053; 29/890.05

[58] Field of Search ..... 29/890.049, 890.053, 29/890.05, 890.054; 165/184, 179, 133; 138/170, 171

[56] References Cited

U.S. PATENT DOCUMENTS

| | | | |
|---|---|---|---|
| 3,696,861 | 10/1972 | Webb . | |
| 3,789,915 | 5/1974 | Ford . | |
| 3,850,227 | 11/1974 | Ford . | |
| 3,861,462 | 1/1975 | McLain | 165/179 |
| 3,885,622 | 5/1975 | McLain . | |
| 3,906,605 | 9/1975 | McLain | 165/179 |
| 3,991,822 | 11/1976 | Morris . | |
| 4,044,797 | 8/1977 | Fujie et al. . | |
| 4,561,497 | 12/1985 | Nakajima et al. . | |
| 4,653,163 | 3/1987 | Kuwahara et al. . | |
| 4,658,892 | 4/1987 | Shinohara et al. . | |
| 4,678,029 | 7/1987 | Sasaki et al. . | |
| 4,809,415 | 3/1989 | Okayama et al. . | |
| 4,905,885 | 3/1990 | Hellman, Sr. . | |
| 5,052,476 | 10/1991 | Sukumoda et al. . | |
| 5,184,674 | 2/1993 | Keyes . | |
| 5,215,245 | 6/1993 | Moyer . | |

FOREIGN PATENT DOCUMENTS

| | | | |
|---|---|---|---|
| 2058127 | 6/1992 | Canada | 29/890.049 |
| 0108411 | 4/1990 | Japan | 29/890.049 |
| 2-108411 | 4/1990 | Japan . | |

OTHER PUBLICATIONS

Shinohara, "Development of Various High Efficiency Heat Transfer Copper Tubing", presented to Internation Wrought Copper Council, May 22, 1990.

*Primary Examiner*—Irene Cuda
*Attorney, Agent, or Firm*—Gregory S. Rosenblatt

[57] ABSTRACT

A method for the manufacture of an enhanced heat exchange tube, in which the internal surface area is increased by either minimizing the apex angle of internal fins or increasing the fin height. The fins are formed by annealing a metallic strip while inhibiting recrystallization grain growth, texturing metallic strip, deforming the textured metallic strip into a generally circular configuration and bonding opposing edges of the strip together to form a length of tube.

9 Claims, 3 Drawing Sheets

METHOD OF MANUFACTURING A HEATING EXCHANGE TUBE

BACKGROUND OF THE INVENTION

This invention relates to internally enhanced heat exchange tubes. More particularly, the surface area of the tube bore is increased by either increasing the height of internal fins or reducing the apex angle of internal fins increasing fin density.

In certain refrigeration applications, a heat exchange unit has a liquid refrigerant flowing within a tube while a fluid to be cooled flows externally over the tube. Liquid refrigerants such as trichloromonofluoromethane or dichlorodifluoromethane pass through the exchange tube. The liquid refrigerant absorbs heat from the external liquid and changes state to a gas. The gas phase refrigerant is returned to a compressor, compressed back to liquid, and returned to the heat exchange tube for another cycle.

Some heat exchange tubes have a smooth bore. However, the efficiency of the cooling apparatus is improved when the surface area of the bore is increased. One method for increasing the surface area is to texture the inside wall of the tube.

One method of texturing the bore is to draw a smooth walled tube over a textured plug. The plug deforms the internal bore forming a plurality of parallel spiral ridges. The spiral ridges both increase the surface area and create a controlled flow of refrigerant maximizing the liquid phase contact with the tube.

Both the size of the internal enhancement and the apex angle of the enhancement relative to the tube wall are limited by the method of manufacture. U.S. Pat. No. 4,658,892 to Shinohara et al, discloses that apex angles less than 30° have poor workability and are not practically manufactured. The same patent suggests a fin height of 0.15–0.20 millimeters.

It is known that the maximum efficiency of heat transfer occurs when the ratio of fin height ($F_H$) to inside diameter (ID) of the heat exchange tube is on the order of 0.02 to 0.03. When the ratio exceeds 0.03, the heat transfer fluid within the tube begins to convert from laminar flow to turbulent flow reducing the flow rate and the corresponding heat transfer rate.

With a fin height limited to 0.15 mm–0.20 mm, the maximum inside diameter of the tube is limited to about:

$$F_H/ID = 0.02$$

$$0.2\ mm/ID = 0.02$$

$$ID = 10\ mm\ (0.39\ in.)$$

The limit on the inside diameter of the heat exchange tube is a direct result of the method of manufacture. If an alternative method of manufacture could produce higher fins without tearing or breakage, correspondingly larger inside diameter tubes could be made.

One alternative method to manufacture internally or externally enhanced heat exchange tubes is disclosed in U.S. Pat. No. 3,906,605 to McLain which is incorporated in its entirety by reference herein. The patent discloses texturing a metallic strip by passing the strip through textured rolls. The strip is then deformed into a generally circular configuration bringing the edges in close proximity for welding.

The efficiency of a heat exchange tube would be increased if the McLain process could be adapted to produce internally enhanced tubes having either higher internal fins, a smaller apex angle, or both.

SUMMARY OF THE INVENTION

Accordingly, it is an object of the invention to provide an internally enhanced heat exchange tube having improved heat exchange capability. Yet another object of the invention is to provide a means to manufacture the heat exchange tube by forming a textured metallic strip and welding the edges of the strip to form a length of tube.

It is a feature of the invention that fin heights in excess of about 0.20 millimeters are produced to any apex angle. Preferably, the apex angle is less than about 30°. It is an advantage that the bore of the heat exchange tube has a large surface area increasing the exchange of heat. It is a further advantage that the method of manufacture reduces the tearing and breaking of fins. Since higher fins may be produced by the method of the invention, internally enhanced tubes having a larger inside diameter may be manufactured.

In accordance with the invention, there is provided a welded heat exchange tube. The bore of the tube is internally enhanced by a plurality of fins. These fins have an apex angle relative to the bore of less than about 40°.

The method for forming the tube includes impressing a desired texture into at least one side of a metallic strip. This texture includes a plurality of fins separated by grooves. The apex angle of the fins relative to the surface of the strip is less than about 40°. The textured strip is then deformed into a generally circular configuration with the textured side forming the inner bore. The opposing edges of the strip are brought in close proximity and bonded to form a length of internally enhanced tubing.

The above stated objects, features and advantages will become more apparent from the specification and drawings which follow.

DETAILED DESCRIPTION

Figure 1:
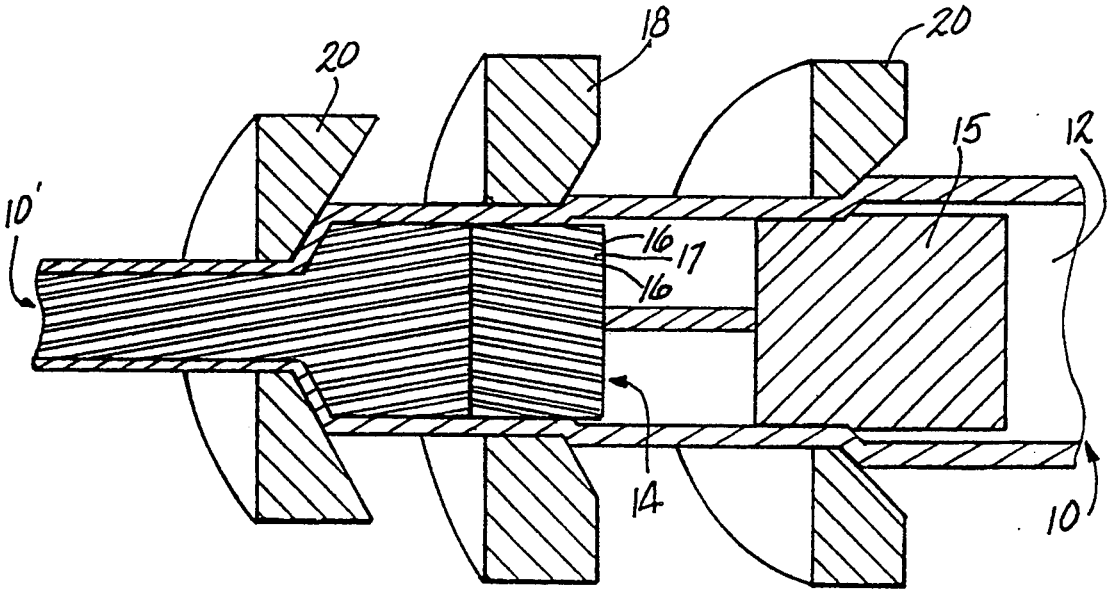
PRIOR ART FIG-1
FIG. 1 shows in cross-sectional representation a method of forming an internally enhanced tube from a smooth bore tube according to the prior art.

FIG. 1 shows in cross-sectional representation a method for forming an internally enhanced heat exchange tube according to the prior art. The tube 10 has a smooth internal bore 12 and is pulled by suitable means, such as a winch (not shown), across a grooved mandrel 14. The grooved mandrel 14 is supported and retained in place by a floating plug 15. The grooved mandrel 14 is textured with a plurality of ridges 16 separated by grooves 17. The grooved mandrel is pressed against the bore 12 by pressure applied by the working head 18. The combination of the grooved mandrel 14 and the working head 18 scores the bore 12, producing enhanced tube 10'. The tube 10' is drawn to a desired diameter by drawing dies 20.

Figure 2:
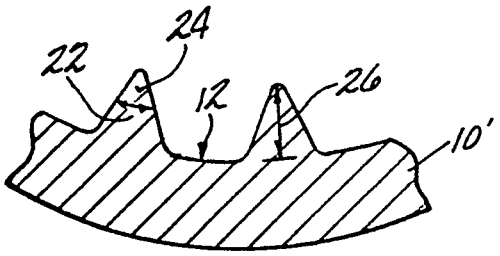
PRIOR ART FIG-2
FIG. 2 shows a typical apex angle and fin produced by the method of the prior art.

The prior art method embodied in FIG. 1 has limitations as identified in FIG. 2. The apex angle 22, the angle of a fin 24 relative to the bore 12 of the tube 10', is greater than about 30° to prevent tearing or deformation of the fins 24 during manufacture. Typically, the apex angle 22 is from 30° to 60°.

The height 26 of the fins 24 is limited by the strength of the material comprising the heat exchange tube 10'. To avoid tearing or deformation of the fins, in a copper or copper based alloy, the typical fin height 26 is less than 0.20 millimeters.

Figure 3:
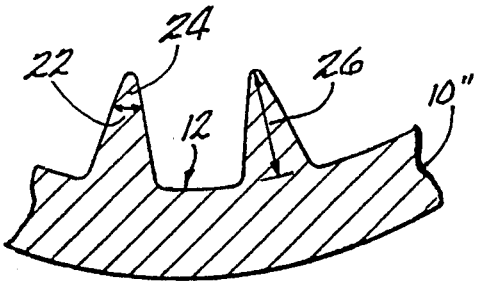
FIG. 3 shows in cross-sectional representation the reduced apex angle and increased fin height of the present invention.

By the use of the roll forming technique described below, an improved heat exchange tube 10'' as illustrated in magnified cross-sectional representation in FIG. 3 is produced. The smaller the apex angle, the higher the fin density. Increasing the fin density results in a higher tube bore surface area for increased thermal transport. The apex angle 22 of the fin 24 relative to the bore 12 of the tube 10'' is less than about 40°. More preferably, the apex angle is from about 15° to about 28° and most preferably, from about 20° to about 25°.

The fin height 26 is in excess of about 0.25 millimeters and preferably from about 0.30 to about 0.50 millimeters and most preferably, from about 0.32 to 0.38 millimeters. The enhanced heat exchange tube 10'' is improved either by reducing the apex angle 22, increasing the fin height 26, or both according to the invention. Either improvement increases the surface area of the tube bore improving the efficiency of heat conduction from an internal refrigerant to the tube 10''.

Figure 4:
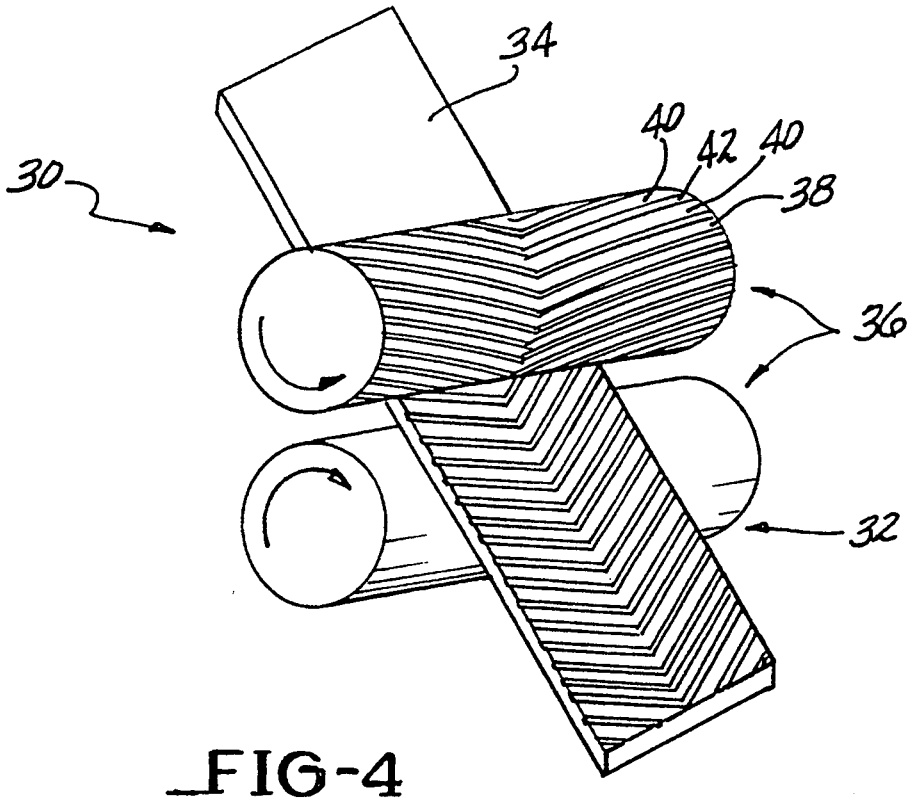
FIG. 4 illustrates a method to texture the surface of a metallic strip in accordance with the invention.

The method of manufacture is illustrated in isometric view in FIG. 4. FIG. 4 shows an apparatus 30 for impressing a textured pattern 32 on at least one side of a metallic strip 34. To maximize thermal conductivity, the metallic strip is preferably copper or a copper based alloy. A set of rolls 36 powered by a rolling mill (not shown) deforms at least one surface 32 of the strip 34.

Roll 38 contacting the side of the strip which will form the inside surface of the welded tube is provided with a desired pattern. The roll 38 is machined to have a plurality of grooves 40 uniformly spaced around the circumference. The grooves may form any desired surface pattern. A double helix centered about the middle of the long axis of the roll is preferred. The double helix facilitates uniform metal flow through the rolls.

A less preferred shape is grooves extending straight across the roll. With straight grooves, it is difficult to obtain sufficient metal flow without breaking the strip. A single helix provides a large thrust, pushing the strip angularly from the rolls and is also less preferred.

Figure 5:
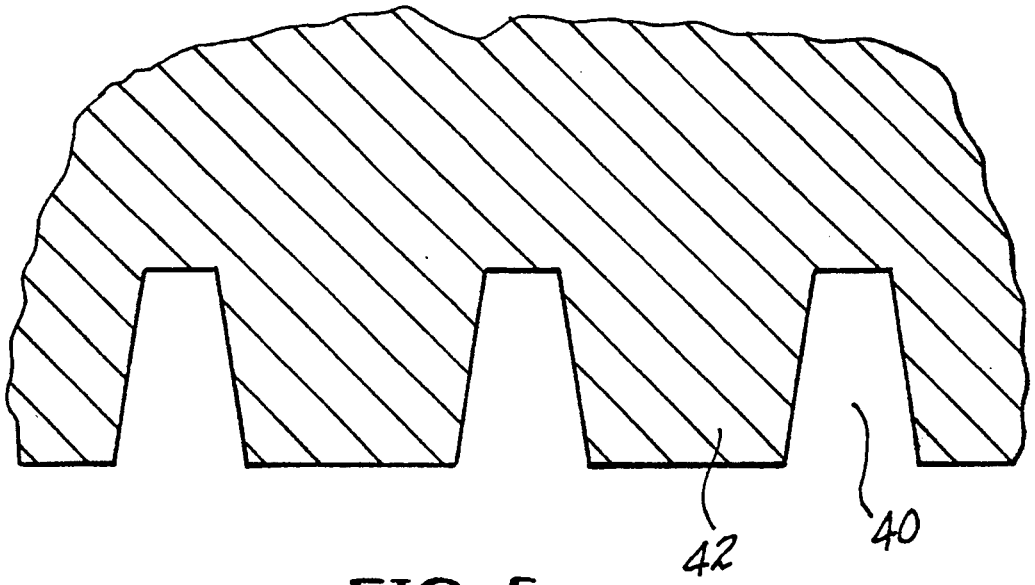
FIG. 5 is a magnified cross-sectional view of a portion of a roll used to impress a texture into the surface of the strip.

Separating the grooves 40 of the roll 38 are roll teeth 42. As shown in magnified cross sectional representation in FIG. 5, the roll teeth 42 which form the grooves in the metallic strip are tapered. The exterior ends of the roll teeth are slightly smaller than the base of the roll teeth. The taper is small, but an angle is necessary so that the roll teeth pierce the metallic strip and separate from the strip without breaking. The roll tooth angle is half the desired apex angle. Preferably, the roll tooth angle is from about 7.5° to about 14° and more preferably, from about 10° to about 12.5°.

The metallic strip deformed by the roll teeth 42 flows into the grooves 40 forming enhancement fins. The amount of metal which can be moved is a factor of the temper and composition of the metallic strip, as well as the deforming means. The separating force of the rolling mill should be sufficient to move from about 30% to about 60% of the deformed metal into the fin area. Preferably, from about 35% to about 50% of the deformed metal is moved into the fin area In the process of forming the fins, as the separating force applied by the rolling mill increases, the metal goes from an elongation mode to a fin forming mode. This transition point is characterized by an increase in overall gage. The effective separating force is from this transition point and higher.

The portion of the metallic strip deformed by the rolling mill either contributes to the fins or to an increase in the length of the strip. It is desirable to maximize the fin formation and to minimize increase in length. To increase fin height, the friction between the rolls and the strip is reduced. Exemplary ways to reduce friction include polishing or plating the rolls to a smooth finish. One exemplary plating is a chromium flash. Lubrication is another preferred method of reducing friction. A minimal effective amount of lubricant is used to prevent organic contamination of the weld seam and to prevent adherence of the base metal to the roll. To maximize effectiveness, the lubricant is applied as a mist directly to the rolls of the rolling mills. Applying the lubricant to the metallic strip is less preferred. During deformation, a lubricant film on the strip is sheared and the beneficial effect lost. One preferred lubricant is polyethylene glycol.

The metallic strip should be fully annealed, but have sufficiently inhibited recrystallization grain growth to prevent necking. Generally, the crystalline grain size should be a maximum of 0.050 millimeters and preferably, the average grain size should be from about 0.015 to about 0.030 millimeters.

Figure 6:
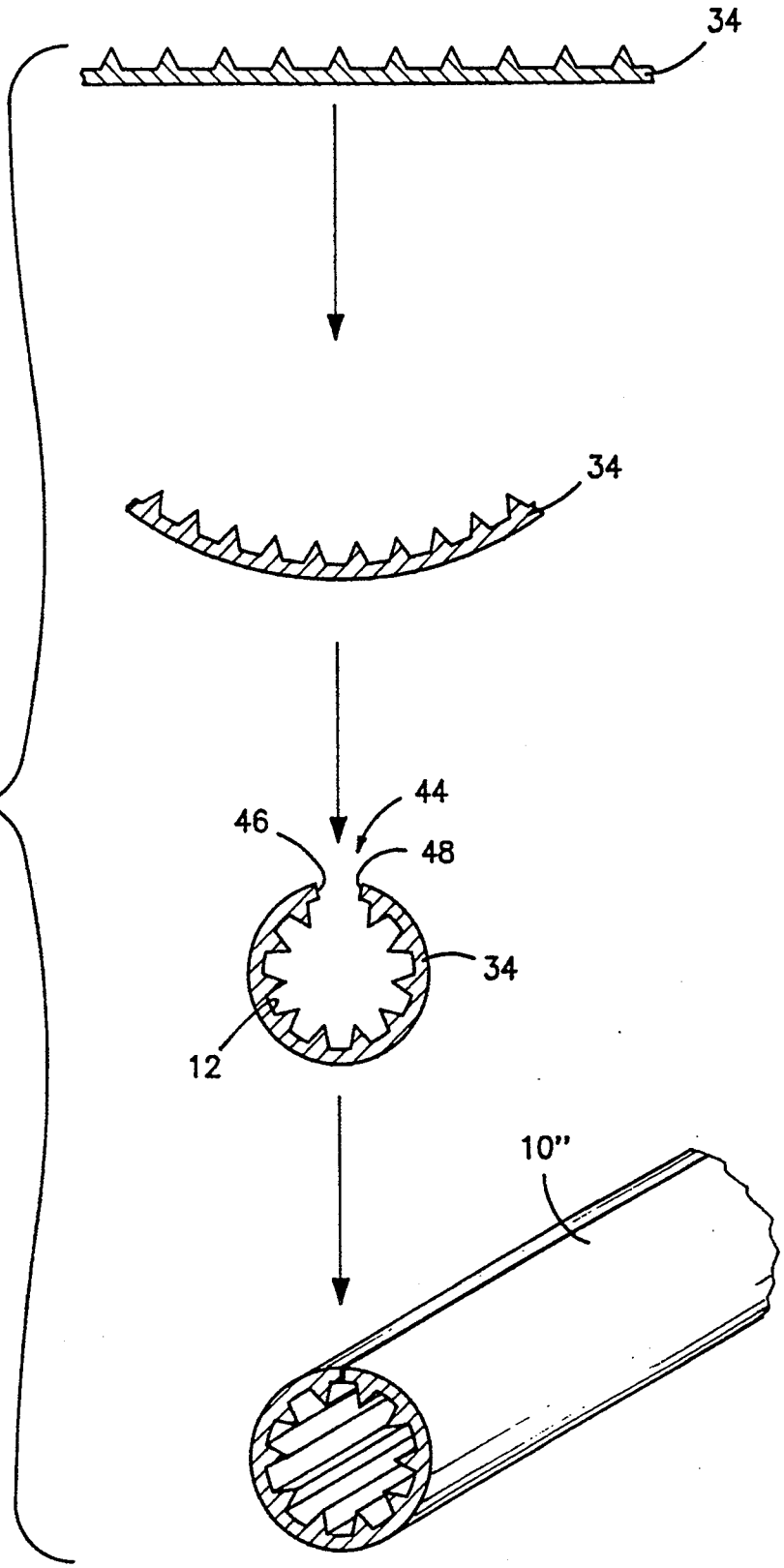
FIG. 6 shows the sequence of forming steps to convert the textured metallic strip into an enhanced welded tube.

The textured strip is then formed into a tube as illustrated in FIG. 6. The metallic strip 34 is deformed into a generally circular configuration 44, such as by passing through a series of forming rolls. The enhanced bore side 12 of the metallic strip 34 forms the internal bore of the circular structure 44.

The opposing edges 46, 48 of the metallic strip 34 are brought in close proximity and bonded together forming the enhanced tube 10''. A preferred bonding method is welding such as by a TIG torch or induction welding.

While the invention is directed to the manufacture of internally enhanced heat exchange tubes, the process is useful for other heat exchange surfaces requiring a plurality of closely spaced fins, for example, planar heat exchange surfaces.

The patents set forth in the application are intended to be incorporated herein by reference.

It is apparent that there has been provided in accordance with this invention, a method for the manufacture of an internally enhanced heat exchange tube having increased fin height or a reduced fin apex angle which fully satisfies the objects, means and advantages set forth hereinbefore. While the invention has been described in combination with specific embodiments and examples thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A method for the manufacture of a heat exchange tube, comprising the steps of:

(a) annealing a metallic strip while inhibiting recrystallization grain growth;

(b) impressing a desired texture on at least one side of said metallic strip, said texture including a plurality of fins separated by grooves;

(c) deforming said metallic strip into a generally circular configuration with said textured side forming the inner bore;

(d) bringing opposite edges of said metallic strip in close proximity; and (e) bonding said opposing edges together to form a length of internally enhanced tubing.

2. The method of claim 1 wherein said impressing step is passing said metallic strip through a rolling mill having at least one roll with a desired pattern wherein from about 30% to about 60% of the metallic strip deformed during said impression step is moved into said roll pattern.

3. The process of claim 2 wherein from about 35% to about 50% of said metallic strip deformed is moved into said roll pattern.

4. The method of claim 2 including reducing the fiction between said rolling mill and said said metal strip prior to impressing said desired texture.

5. The method of claim 4 wherein the means for reducing friction is applying a lubricant to the rolls of said rolling mill.

6. The method of claim 2 wherein said annealing step produces said metallic strip with a maximum average grain size of less than about 0.050 millimeters.

7. The method of claim 6 wherein said annealing step produces said metallic strip with an average grain size of from about 0.015 to about 0.030 millimeters.

8. The method of claim 2 wherein said fins are formed to a height in excess of about 0.25 millimeters.

9. The method of claim 8 wherein said fins are formed to a height of from about 0.30 to about 0.50 millimeters.

* * * * *

UNITED STATES PATENT AND TRADEMARK OFFICE

CERTIFICATE OF CORRECTION

PATENT NO. : 5,388,329

DATED : February 14, 1995

INVENTOR(S) : Randlett et al

It is certified that error appears in the above-indentified patent and that said Letters Patent is hereby corrected as shown below:

On the title page: Item [54]and Column 1, line 2, "METHOD OF MANUFACTURING A [HEATING] HEAT EXCHANGE TUBE"

At Column 1, line 1, please delete "HEATING" and insert --heat-- in its place.

Signed and Sealed this

Twenty-fifth Day of April, 1995

*Attest:*

Bruce Lehman

BRUCE LEHMAN

*Attesting Officer*

*Commissioner of Patents and Trademarks*